US007610883B2

(12) United States Patent
Noguchi

(10) Patent No.: US 7,610,883 B2
(45) Date of Patent: Nov. 3, 2009

(54) VALVE TIMING CONTROL APPARATUS

(75) Inventor: Yuji Noguchi, Obu (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 183 days.

(21) Appl. No.: 11/822,850

(22) Filed: Jul. 10, 2007

(65) Prior Publication Data

US 2008/0047515 A1 Feb. 28, 2008

(30) Foreign Application Priority Data

Aug. 23, 2006 (JP) ..... 2006-226433

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS 5,937,810 A 8/1999 Sato et al.
6,532,921 B2 3/2003 Sato et al.
2003/0033999 A1* 2/2003 Gardner et al. ..... 123/90.17
2003/0230268 A1* 12/2003 Simpson et al. ..... 123/90.17
2005/0284433 A1* 12/2005 Yaoko et al. ..... 123/90.17

FOREIGN PATENT DOCUMENTS

JP 09-151711 A 6/1997
JP 2002-168103 A 6/2002

* cited by examiner

*Primary Examiner*—Zelalem Eshete
(74) *Attorney, Agent, or Firm*—Buchanan Ingersoll & Rooney PC

(57) ABSTRACT

A valve timing control apparatus includes a driving side rotational member, a driven side rotational member arranged coaxially to the driving side rotational member, a fluid pressure chamber defined into an advanced angle chamber and a retarded angle chamber, a relative rotational phase adjusting mechanism controlling to selectively supply and drain a working fluid to and from the advanced angle chamber and the retarded angle chamber and adjusting a relative rotational phase of the driving side rotational member and the driven side rotational member, and a valve mechanism provided at the advanced angle chamber and establishing communication between an outside of the fluid pressure chamber and the advanced angle chamber in order to allow the driven side rotational member to advance when a fluctuated torque generated at a camshaft exceeds a torque applied to the driven side rotational member by the relative rotational phase adjusting mechanism.

18 Claims, 7 Drawing Sheets

VALVE TIMING CONTROL APPARATUS

CROSS REFERENCE TO RELATED APPLICATIONS

This application is based on and claims priority under 35 U.S.C. §119 with respect to Japanese Patent Application No. 2006-226433 filed on Aug. 23, 2006, the entire content of which is incorporated herein by reference.

FIELD OF THE INVENTION

The present invention relates to a valve timing control apparatus for an engine mounted on a vehicle, or the like. More particularly, the present invention pertains to a valve timing control apparatus which controls an opening/closing timing of an intake valve and/or an exhaust valve on the basis of driving conditions of an engine.

BACKGROUND

A known valve timing control apparatus of this kind includes a driving side rotational member, which rotates synchronously to a crankshaft, and a driven side rotational member which is arranged coaxially to the driving side rotational member so as to rotate relative to the driving side rotational member and to rotate integrally to a camshaft. According to the known valve timing control apparatus, a fluid pressure chamber is formed between the driving side rotational member and the driven side rotational member. The fluid pressure chamber is defined into an advanced angle chamber and a retarded angle chamber. The known valve timing control apparatus further includes a relative rotational phase adjusting mechanism which is capable of adjusting a relative rotational phase of the driving side rotational member and the driven side rotational member between a most advanced angle phase where the volume of the advanced angle chamber is maximized and a most retarded angle phase where the volume of the advanced angle chamber is minimized by supplying or draining a working fluid to or from the advanced angle chamber and the retarded angle chamber.

With an engine which includes the known valve timing control apparatus explained above, upon the rotation of the crankshaft, the rotation of the crankshaft is transmitted to the driving side rotational member via a chain belt or a timing belt to rotate the camshaft connected to the driving side rotation member. Accordingly, the camshaft rotates with a constant ratio of rotation speed relative to a rotation speed of the crankshaft (that is, engine rotation speed).

Upon the rotation of the camshaft, the intake valves and/or the exhaust valves (i.e., hereinafter referred to as the valve) are operated in response to the operation of cams. In those circumstances, the camshaft receives a fluctuated torque every time the valve operates. In other words, the camshaft receives a torque applied in a reverse direction reversing from the rotating direction by a resistance force caused by a compression of a valve spring when opening the valve (i.e., reversing torque), and receives a torque in the same direction to the rotating direction by a biasing force deriving from the extension of the valve spring when closing the valve (i.e., positive torque). The torque fluctuation in the positive and reverse directions which is received by the camshaft affects the driven side rotational member.

Normally, relative rotational phase of the driven side rotational member relative to the driving side rotational member is positioned at the most retarded angle phase before the engine starting. Upon the starting of the engine, the working fluid is supplied to an advanced angle oil path by the relative rotational phase adjusting mechanism. When a lock pin is released by the hydraulic pressure of the working fluid, the working fluid is supplied to the advanced angle chamber to displace the driven side rotational member in an advancing direction.

However, at the engine start-up, because the hydraulic pressure in the engine is not adequately enhanced and the fluid pressure chamber is not filled with working fluid, the driven side rotational member is susceptible to the fluctuated torque by the operation of the cam. Namely, the driven side rotational member is gradually displaced in the advancing direction accompanying undesired fluctuated movement by alternately receiving the fluctuated torque in the positive direction and in the reverse direction. In those circumstances, in case the fluctuated torque in the positive direction exceeds the torque applied to the driven side rotational member by the relative rotational phase adjusting mechanism to excessively advance the driven side rotational member in the advancing angle direction, the inside of the advanced angle chamber has a vacuum pressure instantly. This hampers the displacement of the driven side rotational member in the advancing angle direction. As a result, the undesired fluctuated movement of the driven side rotational member can be restrained to some extent.

On the other hand, immediately after the engine start-up, it is required to quickly set the relative rotational phase of the driving side rotational member and the driven side rotational member to be a predetermined state. A known valve timing control apparatus described in JP2002-168103A attempts to quickly displace the driven side rotational member in the advancing angle direction effectively using the undesired fluctuated movement of the driven side rotational member in the advancing angle direction when receiving the fluctuated toque.

According to the valve timing control apparatus described in JP2002-168103A, a communication passage which communicates the advanced angle chamber and the retarded angle chamber is formed on the driving side rotational member. A control valve, which allows the working fluid to flow from the retarded angle chamber to the advanced angle chamber and which impedes a flow of the working fluid from the advanced angle chamber to the retarded angle chamber, is provided at the communication passage. When the camshaft further rotates in the advancing angle direction receiving the positive torque, in a state where the engine rotation speed is low, for example, at the engine start-up, the control valve functions to move the working fluid in the retarded angle chamber to the advanced angle chamber by a volume corresponding to the degree of the advancing angle. The valve timing control apparatus described in JP2002-168103A assists the advancing movement of the driven side rotational member using vibrations applied in the advancing angle direction out of the vibrations of the driven side rotational member deriving from the torque fluctuation in the positive and reverse directions which is applied to the camshaft.

Notwithstanding, according to the valve timing control apparatus described in JP2002-168103A, because the working fluid passes through the communication passage and the control valve, relatively large flow resistance by the working fluid is generated at the communication passage. Accordingly, a relatively long time is required to move the working fluid from the retarded angle chamber to the advanced angle chamber, and thus the working fluid cannot be quickly supplied to the advanced angle chamber in response to the pressure decrease in the advanced angle chamber. In consequence, immediately after the engine start-up, relatively long time is required before the driven side rotational member is displaced to be positioned at a predetermined relative rotational phase. Further, because the communication passage and the control valve are formed inside the driving side rotational member, rotation of the driving side rotational member is unbalanced and the structure thereof is also complicated. Still further, because an operational direction of a movable member, which is provided at the control valve, is directed approximately along the rotational direction of the driving side rotational member, an accelerating force or a decelerating force is applied to the movable member in accordance with changes of the rotational speed of the driving side rotational member, which is likely to bring the erroneous operation of the control valve.

A need thus exists for a valve timing control apparatus, which is not susceptible to the drawback mentioned above.

SUMMARY OF THE INVENTION

In light of the foregoing, the present invention provides a valve timing control apparatus for an engine, which includes a driving side rotational member rotating synchronously to a crankshaft, a driven side rotational member arranged coaxially to the driving side rotational member to be relatively rotatable and rotating integrally to a camshaft, a fluid pressure chamber formed between the driving side rotational member and the driven side rotational member and defined into an advanced angle chamber and a retarded angle chamber, a relative rotational phase adjusting mechanism controlling to selectively supply and drain a working fluid to and from the advanced angle chamber and the retarded angle chamber and adjusting a relative rotational phase of the driving side rotational member and the driven side rotational member between a most advanced angle phase where a volume of the advanced angle chamber is maximized and a most retarded angle phase where the volume of the advanced angle chamber is minimized, and a valve mechanism provided at the advanced angle chamber and establishing communication between an outside of the fluid pressure chamber and the advanced angle chamber in order to allow the driven side rotational member to advance when a fluctuated torque generated at the camshaft exceeds a torque applied to the driven side rotational member by the relative rotational phase adjusting mechanism.

According to another aspect of the present invention, a valve timing control apparatus for an engine includes a driving side rotational member rotating synchronously to a crankshaft, a driven side rotational member arranged coaxially to the driving side rotational member to be relatively rotatable and rotating integrally to a camshaft, a fluid pressure chamber formed between the driving side rotational member and the driven side rotational member and defined into an advanced angle chamber and a retarded angle chamber, a relative rotational phase adjusting mechanism controlling to selectively supply and drain a working fluid to and from the advanced angle chamber and the retarded angle chamber and adjusting a relative rotational phase of the driving side rotational member and the driven side rotational member between a most advanced angle phase where a volume of the advanced angle chamber is maximized and a most retarded angle phase where the volume of the advanced angle chamber is minimized, and a one-way valve provided at the advanced angle chamber and allowing communication from an outside of the fluid pressure chamber to the advanced angle chamber.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

Embodiments of the present invention will be explained with reference to illustrations of drawing figures as follows.

Figure 1:
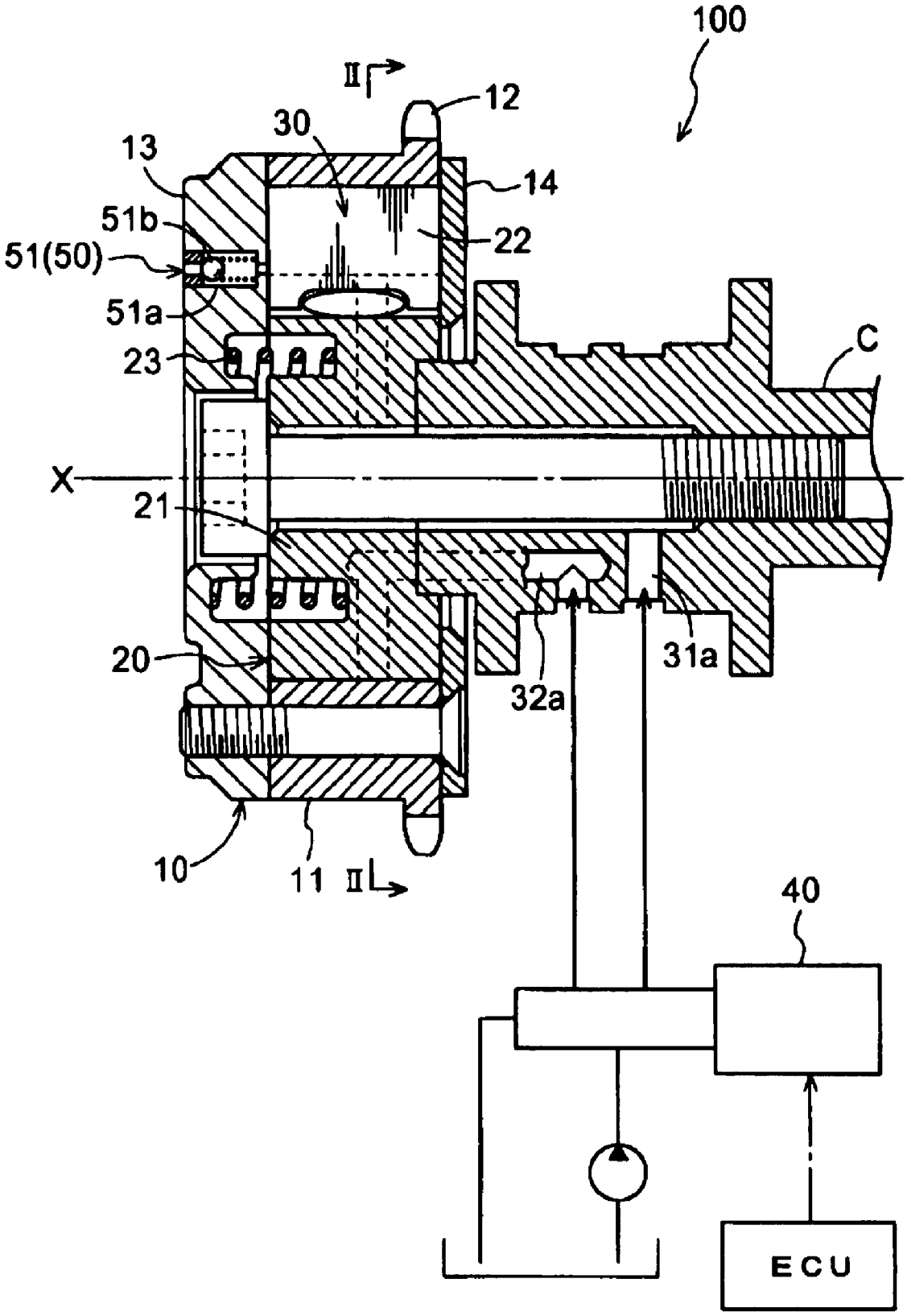
FIG. 1 is a lateral cross-sectional view of a valve timing control apparatus according to a first embodiment of the present invention.

As shown in FIG. 1, a valve timing control apparatus 100 includes a driving side rotational member 10, a driven side rotational member 20, a fluid pressure chamber 30, and a relative rotational phase adjusting mechanism 40.

The driving side rotational member includes a housing 11 and a timing sprocket 12 which is formed on the housing 11 along an outer periphery of the housing 11. A front plate 13 and a rear plate 14 are connected to a front side and a rear side of the housing 11 respectively. The timing sprocket 12 is connected to a crank sprocket provided at an end side of a crankshaft CR of an engine 1000 via a timing chain. With this construction, the driving side rotational member 10 rotates synchronously to the crankshaft CR. Although the timing chain is applied for transmitting a driving force of the engine 1000 to a camshaft C, alternatively, a timing belt may be applied. In case the timing belt is applied, a timing pulley is applied instead of the timing sprocket 12.

The driven side rotational member 20 includes a rotor 21 and vanes 22. The driven side rotational member 20 is arranged coaxially to the driving side rotational member 10 so as to be rotatable relative to the driving side rotational member 10. With this construction, the driven side rotational member 20 can be displaced in an advancing angle direction (i.e., arrowed direction A) or in a retarded angle direction (i.e., arrowed direction B) relative to the driving side rotational member 10. As shown in FIG. 1, a return spring 23 may be provided in the driven side rotational member 20 to assist the displacement of the driven side rotational member 20 in the advancing angle direction. A relative rotational phase of the driving side rotational member 10 and the driven side rotational member 20 is adjusted by the relative rotational phase adjusting mechanism 40. Further, the driven side rotational member 20 is connected to the camshaft C so as to be integrally rotatable therewith. Accordingly, a torque applied to the camshaft C directly affects the driven side rotational member 20.

The fluid pressure chamber 30 is formed between the driving side rotational member 10 and the driven side rotational member 20. The fluid pressure chamber 30 is defined into an advanced angle chamber 31 and a retarded angle chamber 32 by the vanes 22 of the driven side rotational member 20. An advanced angle oil passage 31*a* is connected to the advanced angle chamber 31. A retarded angle oil passage 32*a* is connected to the retarded angle chamber 32. Although, for example, four fluid pressure chambers 30 are formed on the valve timing control apparatus 100 as shown in FIG. 1, at least one fluid pressure chamber 30 is provided according to the subject matter of the valve timing control apparatus.

For example, an electromagnetic solenoid valve is applied as the relative rotational phase adjusting mechanism 40. The relative rotational phase adjusting mechanism 40 is configured to control to switch a supplying mode in which the working fluid supplied from an oil pump is supplied either to the advanced angle chamber 31 through the advanced angle oil passage 31*a* or to the retarded angle chamber 32 through the retarded angle oil passage 32*a* and a draining mode in which the working fluid either in the advanced angle chamber 31 or the retarded angle chamber 32 is drained to an oil pan. The relative rotational phase adjusting mechanism 40 adjusts supplying volume and draining volume of the working fluid on the basis of a control command from an ECU for the engine 1000. Accordingly, the relative rotational phase of the driving side rotational member 10 and the driven side rotational member 20 can be adjusted between a most advanced angle phase where the volume of the advanced angle chamber 31 is maximized and a most retarded angle phase where the volume of the advanced angle chamber 31 is minimized.

Figure 2:
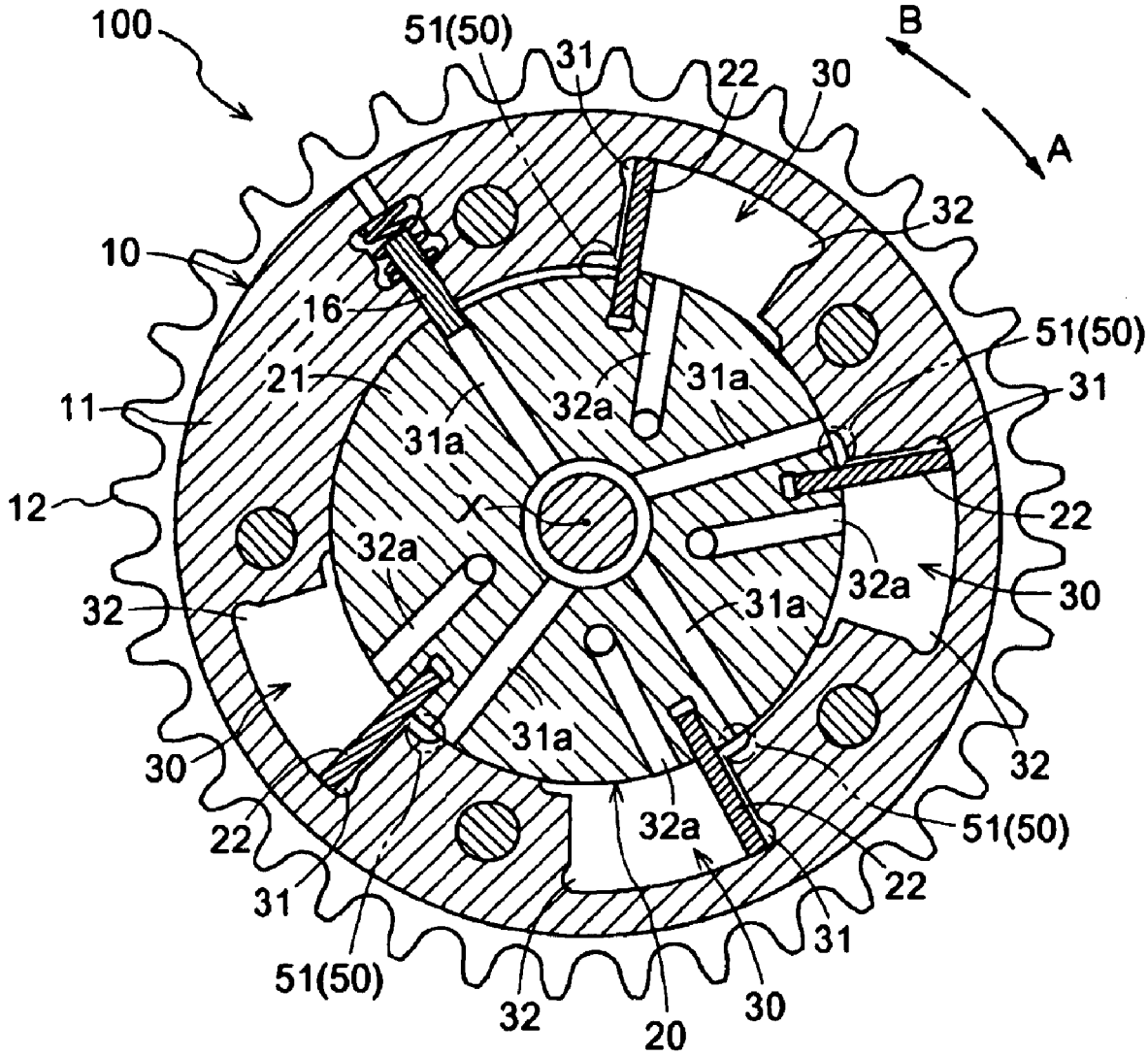
FIG. 2 is a front cross-sectional view showing the valve timing control apparatus in a non-operational state taken on line II-II of FIG. 1.

When the engine 1000 is not operated, the working fluid is supplied neither to the advanced angle oil passage 31*a* nor to the retarded angle oil passage 32*a*. Thus, the driven side rotational member 20 cannot be retained to be stable between the most advanced angle phase and the most retarded angle phase. While the engine 1000 is not operated, as shown in FIG. 2, the driven side rotational member 20 is biased to the most retarded angle phase side and a lock pin 16 provided at the driving rotational member 10 is engaged with the driven side rotational member 20 to retain the driven side rotational member 20 at the most retarded angle phase side. Accordingly, an unnecessary movement of the driven side rotational member 20, when the engine is not operated, can be prevented.

Figure 3:
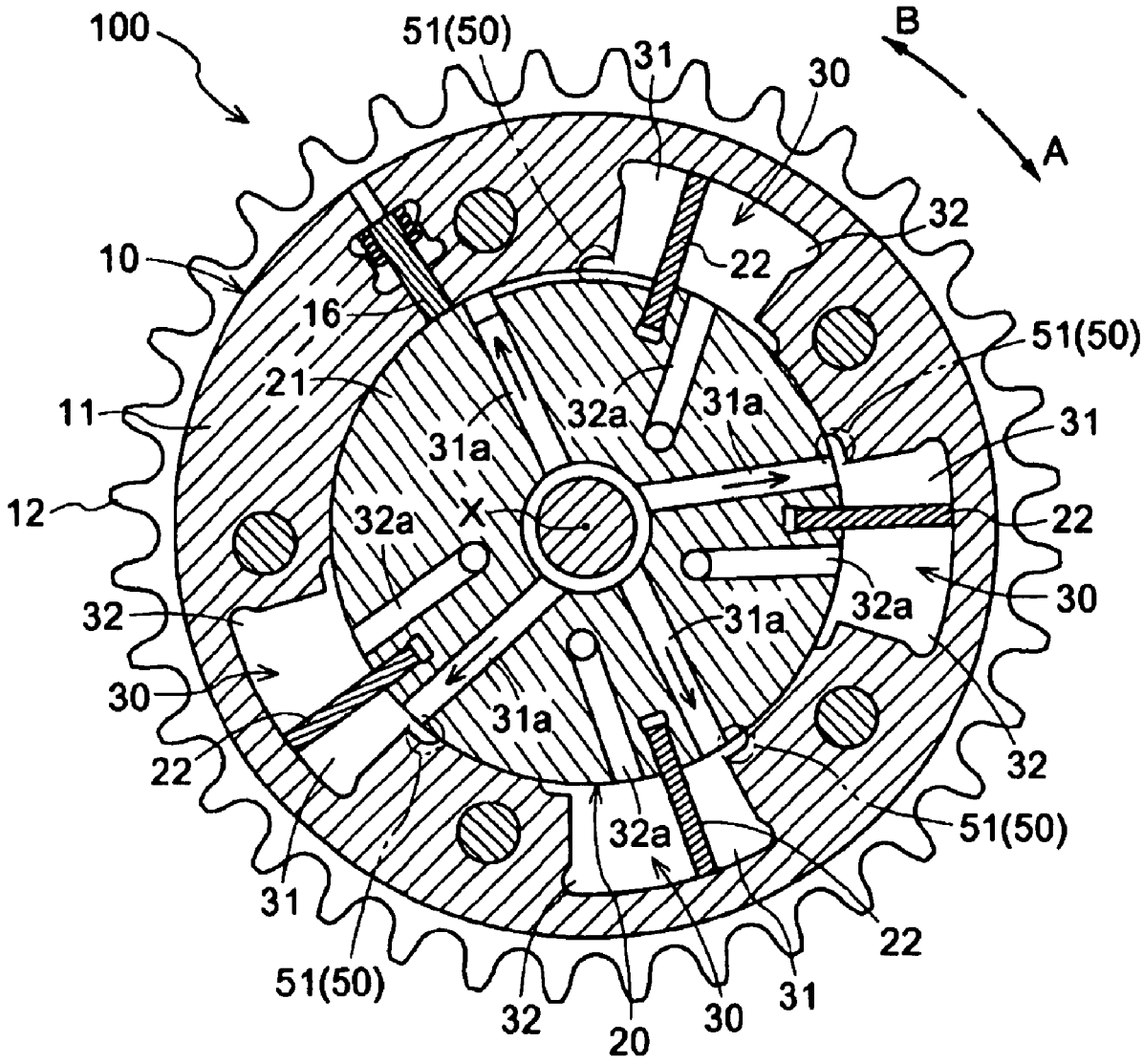
FIG. 3 is a front cross-sectional view showing the valve timing control apparatus in an operational state taken on line II-II of FIG. 1.

An operation of the valve timing control apparatus 100 will be explained as follows. Upon a rotation of a starter in order to start the engine 1000, the working fluid is supplied to the advanced angle chamber 31*a* on the basis of the operation of the relative rotational phase adjusting mechanism 40. When the lock pin 16 is released by the hydraulic pressure of the working fluid, the working fluid is supplied to the advanced angle chamber 31, and, as shown in FIG. 3, the driven side rotational member 20 is displaced (i.e., moved) from the most retarded angle phase in the advancing angle direction (i.e., arrowed direction A). In those circumstances, upon the rotation of the camshaft C which is provided integrally to the driven side rotational member 20, a fluctuated torque generated when a cam opens and closes an intake or exhaust valve V (shown in FIG. 8) directly affects the driven side rotational member 20. The fluctuated torque is a reversing torque which is applied in a reverse direction of the rotation, which derives from the resistance force by the compression of a valve spring when opening the valve V and a positive torque which is applied in a positive direction of the rotation, which derives from a biasing force by an extension of the valve spring when closing the valve V. Effectively using the positive torque among those fluctuated torques, a displacement rate of the driven side rotational member 20 in the advancing angle direction is increased, and thus the quick displacement of the driven side rotational member 20 in the advancing direction can be achieved.

According to the embodiment of the present invention, in order to allow increasing the displacement rate of the driven side rotational member 20 in the advancing angle direction, a valve mechanism 50 which is configured to establish the communication between outside of the fluid pressure chamber 30 and the advanced angle chamber 31 is provided at the advanced angle chamber 31 (i.e., the valve mechanism 50 is positioned to be in communication with the advanced angle chamber 31). The valve mechanism 50, for example, is a one-way valve 51 which allows the communication from the outside of the fluid pressure chamber 30 to the advanced angle chamber 31 and restricts the communication in a reverse direction. The one-way valve 51 includes a valve body 51*a* and a movable member 51*b* which is housed in the valve body 51*a*. In response to the movement of the movable member 51*b* in the valve body 51*a*, the communication between the outside of the fluid pressure chamber 30 and the advanced angle chamber 31 can be selectively established and blocked. As long as allowing the communication from the outside of the fluid pressure chamber 30 to the advanced angle chamber 31 and restricting the communication in the reverse direction, other types of valves can be applied as the valve mechanism 50 instead of the one-way valve 51. For example, a plate valve or a butterfly valve is applicable.

After the engine 1000 started, when the fluctuated torque generated at the camshaft C exceeds a torque applied to the driven side rotational member 20 by the relative rotational phase adjusting mechanism 40, fluctuated movement is generated at the driven side rotational member 20. In those circumstances, the driven side rotational member 20 is likely to advance exceeding a predetermined relative rotational phase which is adjusted by the relative rotational phase adjusting mechanism 40. In other words, the volume of the advanced angle chamber 31 is likely to be excessive compared to the incremental rate of the working fluid in the advanced chamber 31. Accordingly, the pressure inside the advanced angle chamber 31 starts declining. In those circumstances, according to the first embodiment of the present invention, immediately after the pressure in the advanced angle chamber 31 starts declining, the one-way valve 51 provided at the advanced angle chamber 31 is released immediately to communicate the outside of the fluid pressure chamber 30 with the advanced angle chamber 31. Thereafter, the air existing in the outside of the fluid pressure chamber 30 is swiftly introduced to the advanced angle chamber 31 to balance the pressure in the advanced angle chamber 31 and the outside of the fluid pressure chamber 30 to be at an equal level. Accordingly, the vacuum pressure which tries to hold the driven side rotational member 20 at the advanced angle chamber 31 side is not generated in the advanced angle chamber 31, and thus the driven side rotational member 20 can rotate appropriately. In consequence, the driven side rotational member 20 is quickly displaced in the advancing angle direction (i.e., arrowed direction A).

As explained above, by introducing the outside air into the advanced angle chamber 31 through the one-way valve 51 provided at the advanced angle chamber 31, the pressure decline in the advanced angle chamber 31 can be prevented readily and quickly, and thus the driven side rotational member 20 can be displaced quickly in the advancing angle direction. Further, because a medium which passes through the one-way valve 51 is the air, the volume of the working fluid required for the valve timing control apparatus 100 can be reduced and the flow resistance can be also reduced.

On the other hand, when the camshaft C receives the reversing torque, the driven side rotational member 20 is fluctuated to move in the retarded angle direction (i.e., arrowed direction B) to exhaust the working fluid and the air in the advanced angle chamber 31 to the outside. However, the communication between the outside of the fluid pressure chamber 30 and the advanced angle chamber 31 is blocked immediately by means of the one-way valve 51. Accordingly, the advanced angle chamber 31 is substantially closed, and the exhaust of the working fluid from the advanced angle chamber can be prevented. In the meantime, although the air existing in the advanced angle chamber 31 escapes through a gap between the driving side rotational member 10 and the driven side rotational member 20, the volume of the advanced angle chamber 31 is not suddenly reduced because it requires a certain amount of time. Accordingly, when the driven side rotational member 20 starts to fluctuate to move in the retarded angle direction, the inside of the advanced angle chamber 31 is pressurized to have a positive pressure which brings a type of damping effect. In consequence, at the start of the engine 1000, the large degree of the movement of the driven side rotational member 20 in the retarded angle direction can be restrained, and thus to smoothly displace the driven side rotational member 20 in the advancing direction.

As explained above, with the construction of the valve timing control apparatus 100 for the engine 1000 according to the first embodiment, the relative phase of the driven side rotational member 20 is controlled by using the fluctuated torque generated at the camshaft C and by allowing the large degree of the fluctuated movement of the driven side rotational member 20 in the advancing direction. Accordingly, the driven side rotational member 20 can be quickly displaced in the advancing direction immediately after the engine start-up.

The one-way valve 51 is, for example, directly provided on an outer surface of the front plate 13 of the driving side rotational member 10 so that the outside air existing in the outside of the fluid pressure chamber 30 is immediately introduced to the advanced angle chamber 31. This construction shortens a distance between the outside air and an inside of the fluid pressure chamber 30, which shortens the time for introducing the air into the fluid pressure chamber 30. Accordingly, immediately after the engine start-up, the driven side rotational member 20 can be quickly displaced in the advanced angle direction. A construction of the one-way valve 51 which is directly provided on the outer surface of the driving side rotational member 10 is simple and machining onto the valve timing control apparatus can be readily achieved.

Figure 4:
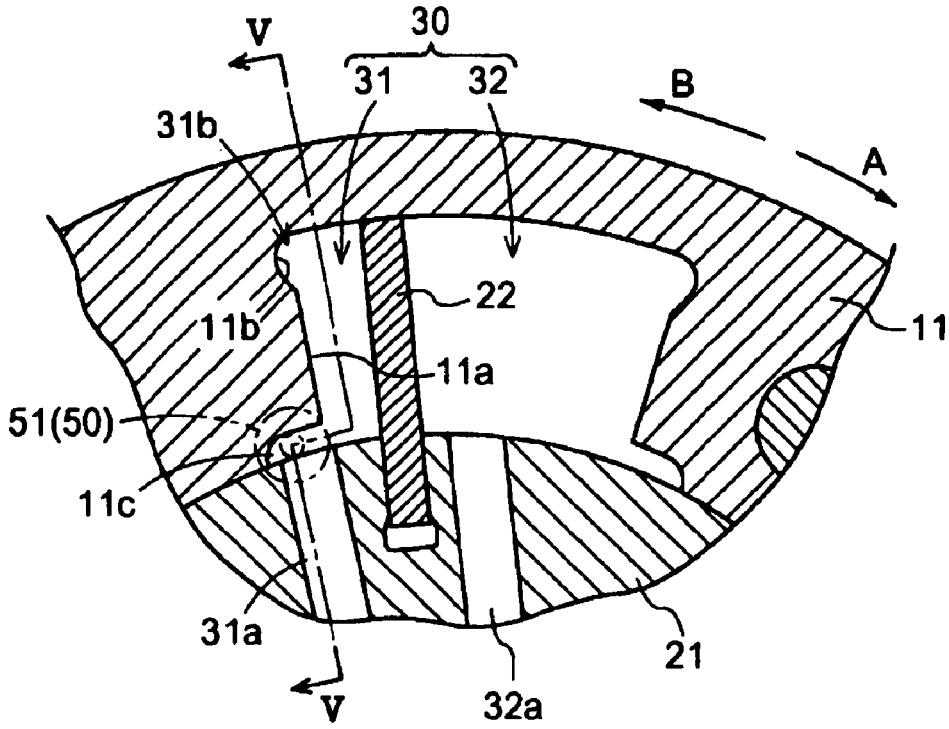
FIG. 4 is a front cross-sectional view of a main portion of the valve timing control apparatus according to the first embodiment of the present invention.
Figure 5:
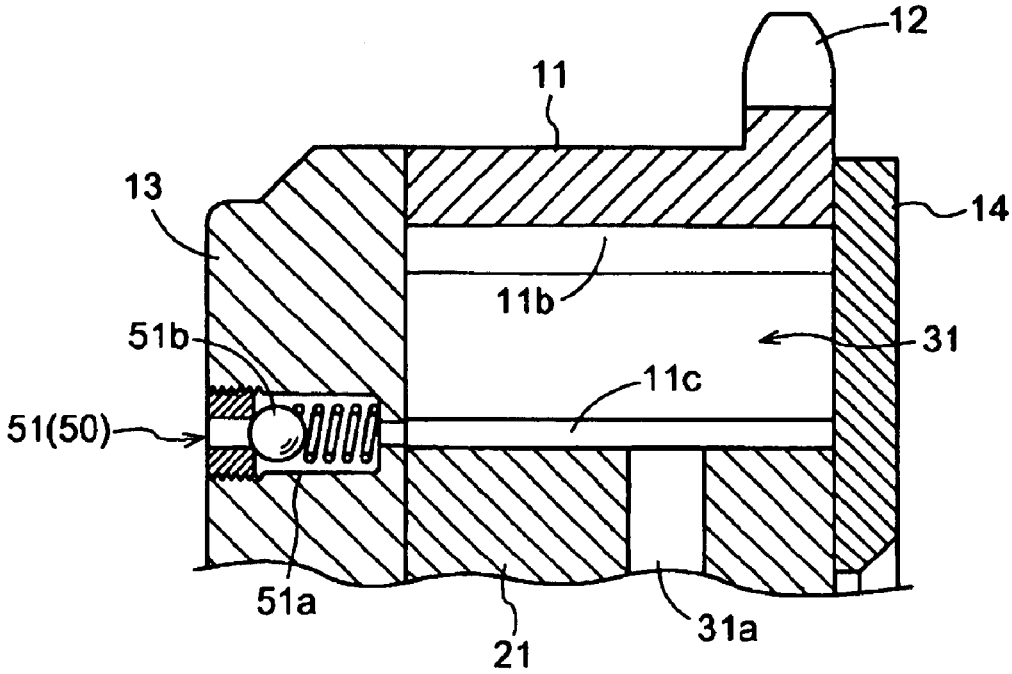
FIG. 5 is a front cross-sectional view of a main portion of the valve timing control apparatus of taken on line V-V of FIG. 4.

Because of frictions of metal members, foreign materials, for example, metal powder and/or sludge, or the like are gradually mixed into the working fluid for the valve timing control apparatus 100. Those foreign materials are likely to be cumulated at the radially outer portion in the advanced angle chamber 31 receiving the centrifugal force by the high-speed rotation of the valve timing control apparatus 100. According to the valve timing control apparatus 100, as shown in FIG. 4, a reservoir 31*b* for foreign materials, which tentatively collects the foreign material mixed in the working fluid, is formed at radially outer portions in the advanced angle chamber 31 viewing from a rotational center.

In those circumstances, it is preferable that the one-way valve 51 is provided avoiding the vicinity of the reservoir 31*b* for foreign materials and positioned closer to the rotational center of the advanced angle chamber 31. As shown in FIG. 4, a stopper 11*a* which stops the vane 22 at the most retarded angle phase is formed on the housing 11 of the driving side rotational member 10. A first recess portion 11*b* which extends in parallel to the camshaft C is formed at a radially outer side of the stopper 11*a* viewing from the rotational axis X of the driving side rotational member 10. The first recess portion 11*b* serves as a side wall for the reservoir 31*b* for the foreign materials. A groove portion 11*c* which is connected to the advanced angle oil passage 31*a* is formed at the radially inner side of the stopper 11*a* viewing from the rotational axis X. The groove portion 11*c* is also extended in parallel to the camshaft C. The one-way valve 51 is arranged at an end portion of the groove portion 11*c* at the front plate 13 side so as to open an outlet port. By providing the first recess portion 11*b* and the groove portion 11*c* sandwiching the stopper 11*a*, the one-way valve 51 is positioned displacing to the rotational center relative to the reservoir 31*b* for the foreign materials. With the foregoing construction, foreign materials in the reservoir 31*b* are unlikely to enter in the one-way valve 51. Accordingly, the decline of the opening and closing function of the one-way valve 51 and failures thereof can be prevented. Further, in case foreign materials in the working fluid is removed by an oil filter which is additionally provided, the one-way valve 51 is unnecessarily positioned displacing towards the rotational center side relative to the reservoir 31*b* for the foreign materials.

According to the first embodiment of the present invention, as shown in FIG. 1, the movable member 51*b* of the one-way valve 51 is configured to be movable approximately in parallel to the rotational axis X of the driving side rotational member 10. According to this construction, the movable member 51*b* of the one-way valve 51 moves approximately perpendicular to the direction of the centrifugal force generated by the high-speed rotation of the valve timing control apparatus 100. Thus, the movable member 51*b* operates in a state receiving less influence by the centrifugal force, and the opening and closing operation of the one-way valve 51 is secured.

Figure 6:
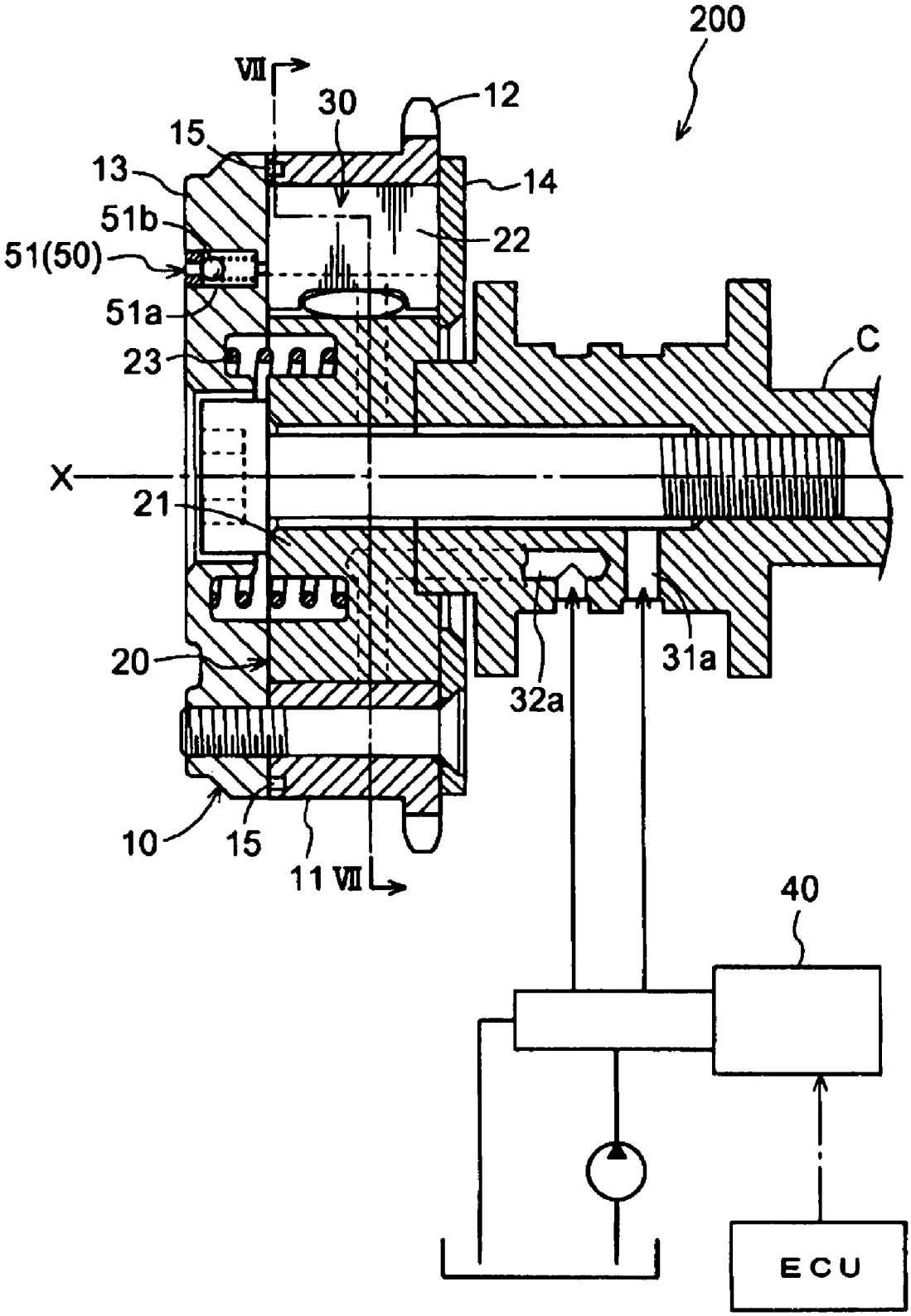
FIG. 6 is a lateral cross-sectional view of a valve timing control apparatus according to a second embodiment of the present invention.
Figure 7:
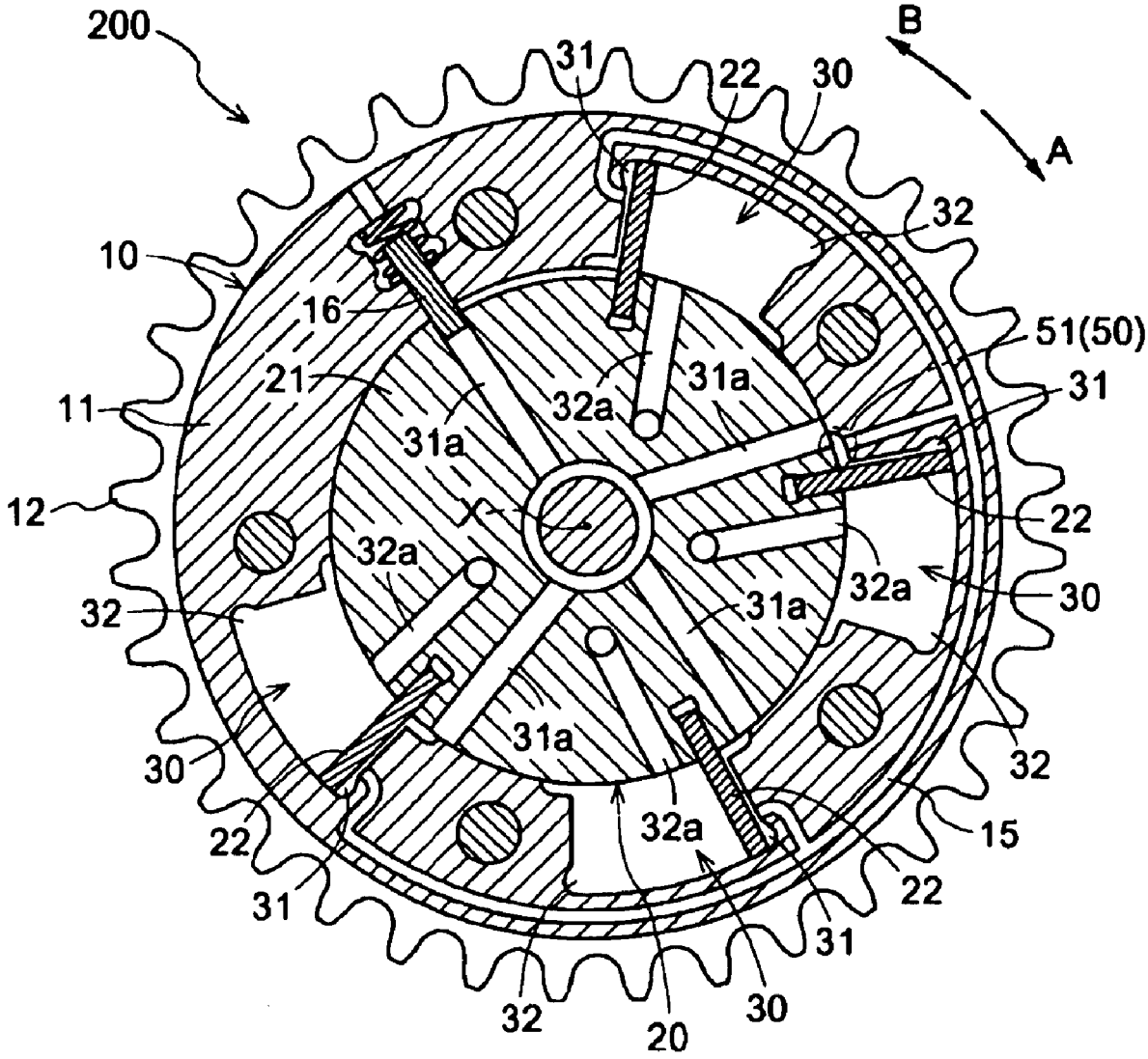
FIG. 7 is a front cross-sectional view of the valve timing control apparatus taken on line VII-VII of FIG. 6.
Figure 8:
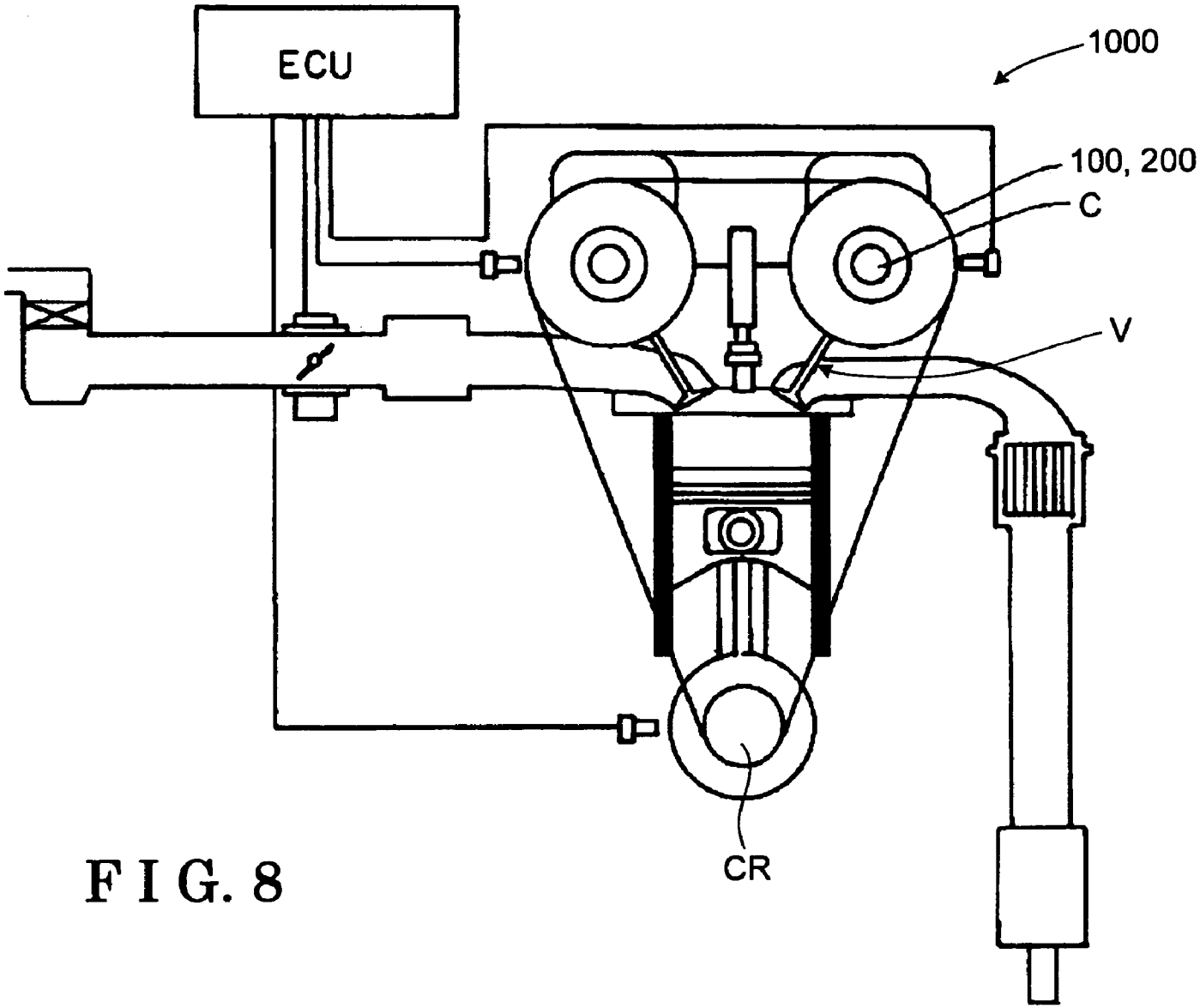
FIG. 8 is an overview of the valve timing control apparatus according to the embodiments of the present invention.

A second embodiment of the present invention will be explained referring to FIGS. 6-8. As shown in FIGS. 6-7, most of constructions of a valve timing control apparatus 200 are common to the constructions of the valve timing control apparatus 100 described in the first embodiment. Explanations for the common constructions to the first embodiment will not be repeated. According to the second embodiment, the one-way valve 51 serving as the valve mechanism 50 is provided only at one of, for example, four advanced angle chambers 31. Further, the valve timing control apparatus 200 according to the second embodiment includes a bypass passage 15 which establishes the communication between the advanced angle chamber 31 provided with the one-way valve 51 and the other advanced angle chambers 31. The bypass passage 15 is, for example, formed at the driving side rotational member 10 in the vicinity of the outer periphery portion. In those circumstances, it is preferable to form the bypass passage 15 on one of the housing 11 or the front plate 13 along contact surfaces therebetween considering the readiness for machining, or the like. Alternatively, it is also applicable that symmetric grooves are formed on the housing 11 and the front plate 13 respectively so that the bypass passage 15 is formed when combining the housing 11 and the front plate 13.

An operation of the valve timing control apparatus 200 according to the second embodiment of the present invention will be explained as follows. Likewise the first embodiment, upon the engine start-up, the communication between the outside of the fluid pressure chamber 30 and the advanced angle chamber 31 is established by the function of the one-way valve 51, and the outside air existing at the outside of the fluid pressure chamber 30 is quickly introduced into the advanced angle chamber 31. According to the second embodiment, the air introduced into the advanced angle chamber 31 which includes the one-way valve 51 flows into the other advanced angle chambers 31 through the bypass passage 15 so that the level of the pressure in, for example, four advanced angle chambers 31 and the level of the pressure outside of the fluid pressure chamber 30 are balanced to be equal. Accordingly, the vacuum pressure which holds the driven side rotational member 20 at the advanced angle chamber 31 side is not generated in each of the advanced angle chambers 31, and thus, the driven side rotational member 20 can be appropriately rotated. In consequence, the driven side rotational member 20 is quickly moved to the advanced angle side (i.e., arrowed direction A).

Further, according to the second embodiment of the present invention, the number of the one-way valve 51 can be reduced. Accordingly, the valve timing control apparatus 200 can be reduced in weight. In consequence, inertia at the rotation of the valve timing control apparatus 200 can be reduced, and precision and speed of the phase control are increased. Further, because the number of the parts is reduced, the manufacturing cost can also be reduced.

According to the second embodiment of the present invention, in addition to the conditions described in the first embodiment, it is preferable that the one-way valve 51 is provided at the advanced angle chamber 31 which is close to the central portion of the length of the bypass passage 15. For example, as shown in FIG. 7, in case there are four fluid pressure chambers 30, it is preferable to position the one-way valve 51 at the advanced angle chamber 31 either of the second or the third from the advanced angle chamber 31 to which an end portion of the bypass passage 15 is in communication. With the foregoing arrangement, a distance from the one-way valve 51 to the advanced angle chamber 31 which is farthest from the one-way valve 51 can be minimized. This can shorten the time required to introduce the air to the every advanced angle chamber 31. Accordingly, the response time of the driven side rotational member 20 is shortened and the response of the driven side rotational member 20 is improved.

According to the subject matter of the valve timing control apparatus 100, 200 for the engine 1000, when the driven side rotational member 20 moves in the advancing direction in a state where the fluctuated torque generated at the camshaft C exceeds the torque applied to the driven side rotational member 20 by the relative rotational phase adjusting mechanism 40, the valve mechanism 50 provided at the advanced angle chamber 31 establishes the communication between the outside of the fluid pressure chamber 30 and the advanced angle chamber 31. With this construction, upon the communication of the fluid pressure chamber 30 with the outside, the advanced angle chamber 31 is released to immediately balance the pressure in the advanced angle chamber 31 and the pressure of the outside to be at an equal level. Accordingly, the vacuum pressure which tries to hold the driven side rotational member 20 at the advanced angle chamber side is not generated, and the driven side rotational member 20 can be freely rotated. In consequence, the driven side rotational member 20 can be quickly displaced in the advanced angle direction.

Features of the embodiments according to the subject matter of the valve timing control apparatus 110, 200 for an engine 1000 includes a driving side rotational member 10 rotating synchronously to a crankshaft CR, a driven side rotational member 20 arranged coaxially to the driving side rotational member 10 to be relatively rotatable and rotating integrally to a camshaft C, a fluid pressure chamber 30 formed between the driving side rotational member 10 and the driven side rotational member 20 and defined into an advanced angle chamber 31 and a retarded angle chamber 32, a relative rotational phase adjusting mechanism 40 controlling to selectively supply and drain a working fluid to and from the advanced angle chamber 31 and the retarded angle chamber 32 and adjusting a relative rotational phase of the driving side rotational member 10 and the driven side rotational member 20 between a most advanced angle phase where a volume of the advanced angle chamber 31 is maximized and a most retarded angle phase where the volume of the advanced angle chamber 31 is minimized, and a one-way valve 51 provided at the advanced angle chamber 31 and allowing communication from an outside of the fluid pressure chamber 30 to the advanced angle chamber 31.

According to the subject matter of the valve timing control apparatus for the engine 1000, when the driven side rotational member 20 displaces in the advanced angle direction relative to the driving side rotational member 10, the one-way valve 51 serving as the valve mechanism 50 provided at the advanced angle chamber 31 allows the communication in the direction from the outside to the advanced angle chamber 31. With this construction, the level of the pressure in the advanced angle chamber 31 and the level of pressure of the outside of the fluid pressure chamber 30 are balanced immediately. Accordingly, the vacuum pressure which tries to hold the driven side rotational member 20 at the advanced angle chamber side is not generated, and the driven side rotational member 20 can be freely rotated. In consequence, the driven side rotational member 20 can displace in the advanced angle direction quickly. When the driven side rotational member 20 vibrates in the retarded angle direction, the communication between the outside of the fluid pressure chamber 30 and the advanced angle chamber 31 is blocked by means of the one-way valve 51 serving as the valve mechanism 50. Accordingly, the advanced angle chamber 31 is substantially closed to maintain the pressure level in the advanced chamber 31 to be constant. Thus, in case the driven side rotational member 20 fluctuates to the retarded angle side, the pressure in the advanced angle chamber 31 becomes the positive pressure to achieve a type of damping effect. As a result, at the engine start-up, the large degree of the movement of the driven side rotational member 20 in the retarded angle direction can be restrained, and the driven side rotational member 20 can be smoothly displaced in the advancing direction.

According to the embodiments of the valve timing control apparatus 110, 200, a medium which passes through the valve mechanism 50 is an outside air.

According to the subject matter of the valve timing control apparatus for the engine 1000, the outside air is introduced from the outside of the fluid pressure chamber 30 to pass through the valve mechanism 50 and thus to be introduced to the advanced angle chamber 31 when the advanced angle chamber 31 starts to be vacuum pressurized because of the fluctuated movement of the driven side rotational member 20 in the advanced angle direction. Accordingly, the pressure decline in the advanced angle chamber 31 can be immediately prevented. As a result, the driven side rotational member 20 becomes free, and can be quickly displaced in the advanced angle direction receiving the fluctuated torque of the camshaft C. Thus, according to the valve timing control apparatus 100, 200 for the engine 1000, only by flowing the outside air into the advanced angle chamber 31, the relative rotational phase between the driving side rotational member 10 and the driven side rotational member 20 can be quickly set. Further, by using the outside air as the medium which passes through the valve mechanism 50, the volume of the working fluid necessary for the valve timing control apparatus 100, 200 can be reduced, and the flow resistance can also be reduced. Still further, because the valve mechanism 50 which passes the outside air can be directly provided on the outer surface of either the driven side rotational member 20 or the driving side rotational member 10, the construction of the apparatus can be simplified and the machining can be ready.

According to the embodiment of the valve timing control apparatus 200, the advanced angle chamber 31 includes plural advanced angle chambers 31, and the valve mechanism 50 is provided at at least one of the advanced angle chambers 31. The valve timing control apparatus 200 further includes a bypass passage 15 connecting the advanced angle chamber 31 provided with the valve mechanism 50 and the other advanced angle chambers 31.

According to the subject matter of the valve timing control apparatus which includes the plural advanced angle chambers 31, it is necessary to prevent the pressure decline caused by the displacement of each of the driven side rotational members 31 in the advancing angle direction. According to the valve timing control apparatus 200, by providing the valve mechanism 50 to at least one of the advanced angle chamber 31 and by forming the bypass passage 15 which communicates the advanced angle chamber 31 having the valve mechanism 50 and the other advanced angle chambers 31, the functions which are the equivalent level with the case where each of the advanced angle chamber 31 includes the valve mechanism 50 can be achieved. Further, because the number of the valve mechanism 50 can be reduced according to the second embodiment of the present invention, the valve timing control apparatus 200 can be reduced in weight. Accordingly, the inertia at the rotation can be reduced, and the precision and the speed of the phase control are improved. Still further, because the number of the parts is reduced, the manufacturing cost can be reduced, accordingly.

According to the embodiments of the valve timing control apparatus 100, 200, the valve mechanism 50 includes a movable member 51*b* which selectively establishes and blocks the communication between the outside of the fluid pressure chamber 30 and the advanced angle chamber 31. The movable member is configured to move approximately in parallel to a rotational axis X of the driving side rotational member 10.

Because the valve timing control apparatus rotates at high speed, the centrifugal force is generated in the radial direction of the rotational direction. According to the subject matter of the valve timing control apparatus 100, 200, with this regard, because the movable member 51*b* of the valve mechanism 50, which establishes or blocks the communication between the outside of the fluid pressure chamber 30 and the advanced angle chamber 31, is configured to move approximately in parallel to the rotational axis X of the driving side rotational ember 10, the valve mechanism 50 is unsusceptible to the centrifugal force generated in the radial direction of the rotation. Namely, the movable member 51*b* moves approximately perpendicular to the centrifugal force which applies in a radial direction of the rotation when the valve timing control apparatus 100, 200 rotates at high speed. Thus, the movable member 51*b* operates under the state having less influence of the centrifugal force, and the opening and closing operation of the valve mechanism can be secured.

According to the embodiment of the valve timing control apparatus 100, 200, the valve mechanism 50 is positioned closer to a rotational center of the advanced angle chamber 31.

Because the valve timing control apparatus rotates at high speed, the foreign materials, for example, sludge are likely cumulated at the outer portion of the advanced angle chamber due to the centrifugal force generated in the radial direction of the rotation. According to the subject matter of the valve timing control apparatus 100, 200, with this regard, because the valve mechanism 50 is positioned closer to the rotational center side of the advanced angle chamber 31 avoiding the position where the foreign materials are likely cumulated, the foreign materials, for example, sludge are not entering to the inside of the valve mechanism 50, and thus the decline of the opening and closing function of the valve and the failure, or the like, can be prevented.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A valve timing control apparatus for an engine, comprising:

a driving side rotational member rotating synchronously to a crankshaft;

a driven side rotational member arranged coaxially to the driving side rotational member to be relatively rotatable and rotating integrally to a camshaft;

a fluid pressure chamber formed between the driving side rotational member and the driven side rotational member and defined into an advanced angle chamber and a retarded angle chamber;

a relative rotational phase adjusting mechanism controlling to selectively supply and drain a working fluid to and from the advanced angle chamber and the retarded angle chamber and adjusting a relative rotational phase of the driving side rotational member and the driven side rotational member between a most advanced angle phase where a volume of the advanced angle chamber is maximized and a most retarded angle phase where the volume of the advanced angle chamber is minimized; and a valve mechanism provided at a passage introducing an outside air to the advanced angle chamber and the valve mechanism allowing communication between an outside of the fluid pressure chamber and the advanced angle chamber to introduce the outside air to the advanced angle chamber when a fluctuated torque generated at the camshaft exceeds a torque applied to the driven side rotational member by the relative rotational phase adjusting mechanism.

2. The valve timing control apparatus according to claim 1, wherein the advanced angle chamber includes a plurality of advanced angle chambers;

the valve mechanism is provided at at least one or the advanced angle chambers; further including a bypass passage connecting the advanced angle chamber provided with the valve mechanism and the other advanced angle chambers.

3. The valve timing control apparatus according to claim 1, wherein the valve mechanism includes a movable member which selectively establishes and blocks the communication between the outside of the fluid pressure chamber and the advanced angle chamber; and wherein the movable member is configured to move approximately in parallel to a rotational axis of the driving side rotational member.

4. The valve timing control apparatus according to claim 1, wherein the valve mechanism is positioned closer to a rotational center of the advanced angle chamber.

5. The valve timing control apparatus according to claim 1, wherein the valve mechanism allows flow of the outside air from the outside of the fluid pressure chamber to the advanced angle chamber.

6. The valve timing control apparatus according to claim 5, wherein the valve mechanism blocks flow of the working fluid from the advanced angle chamber to the outside of the fluid pressure chamber.

7. The valve timing control apparatus according to claim 1, wherein the passage introducing an outside air to the advanced angle chamber is formed in the driving side rotational member.

8. The valve timing control apparatus according to claim 1, wherein the valve mechanism is provided in the driving side rotational member.

9. A valve timing control apparatus for an engine, comprising:

a driving side rotational member rotating synchronously to a crankshaft;

a driven side rotational member arranged coaxially to the driving side rotational member to be relatively rotatable and rotating integrally to a camshaft;

a fluid pressure chamber formed between the driving side rotational member and the driven side rotational member and defined into an advanced angle chamber and a retarded angle chamber;

a relative rotational phase adjusting mechanism controlling to selectively supply and drain a working fluid to and from the advanced angle chamber and the retarded angle chamber and adjusting a relative rotational phase of the driving side rotational member and the driven side rotational member between a most advanced angle phase where a volume of the advanced angle chamber is maximized and a most retarded angle phase where the volume of the advanced angle chamber is minimized; and a one-way valve provided at a passage introducing an outside air to the advanced angle chamber and the one-way valve allowing communication from an outside of the fluid pressure chamber to the advanced angle chamber to introduce the outside air to the advanced angle chamber and blocking the communication from the advanced angle chamber to the outside of the fluid pressure chamber.

10. The valve timing control apparatus according to claim 9, wherein the advanced angle chamber includes a plurality of advanced angle chambers;

the valve mechanism is provided at at least one of the advanced angle chambers; further including a bypass passage connecting the advanced angle chamber provided with the valve mechanism and the other advanced angle chambers.

11. The valve timing control apparatus according to claim 9, wherein the valve mechanism includes a movable member which selectively establishes and blocks the communication between the outside of the fluid pressure chamber and the advanced angle chamber, and wherein the movable member is configured to move approximately in parallel to a rotational axis of the driving side rotational member.

12. The valve timing control apparatus according to claim 9, wherein the valve mechanism is positioned closer to a rotational center of the advanced angle chamber.

13. The valve timing control apparatus according to claim 9, the one-way valve allows flow of the outside air from the outside of the fluid pressure chamber to the advanced angle chamber and blocks flow of the working fluid from the advanced angle chamber to the outside of the fluid pressure chamber.

14. The valve timing control apparatus according to claim 9, wherein the passage introducing an outside air to the advanced angle chamber is formed in the driving side rotational member.

15. The valve timing control apparatus according to claim 9, wherein the one-way valve is provided in the driving side rotational member.

16. A valve timing control apparatus for an engine, comprising:

a driving side rotational member rotating synchronously with a crankshaft;

a driven side rotational member coaxial with the driving side rotational member to be relatively rotatable and rotating integrally to a camshaft;

a fluid pressure chamber between the driving side rotational member and the driven side rotational member, the fluid pressure chamber being divided into an advanced angle chamber and a retarded angle chamber;

a retarded angle oil passage fluidly communicating with the retarded angle chamber;

an advanced angle oil passage fluidly communicating with the advanced angle chamber;

a relative rotational phase adjusting mechanism controlling selective supply and drain of a working fluid to and from the advanced angle chamber and the retarded angle chamber and adjusting a relative rotational phase of the driving side rotational member and the driven side rotational member between a most advanced angle phase where a volume of the advanced angle chamber is maximized and a most retarded angle phase where the volume of the advanced angle chamber is minimized; and a communicating passage communicating the advanced angle chamber to outside the fluid pressure chamber, the communicating passage being different from the retarded angle oil passage and the advanced angle oil passage;

a valve positioned in the communicating passage and comprising a movable member movable to one position allowing air outside the fluid pressure chamber to be introduced into the advanced angle chamber by way of the communicating passage when a fluctuated torque generated at the camshaft exceeds a torque applied to the driven side rotational member by the relative rotational phase adjusting mechanism.

17. The valve timing control apparatus according to claim 16, wherein the movable member comprising the valve is biased toward the one position.

18. The valve timing control apparatus according to claim 16, wherein the movable member is movable from the one position to an other position in which air outside the fluid pressure chamber is prevented from being introduced into the advanced angle chamber by way of the communicating passage.

* * * * *